United States Patent [19]

Fujikura et al.

[11] Patent Number: 4,791,040

[45] Date of Patent: Dec. 13, 1988

[54] MULTILAYERED ELECTROPHOTOGRAPHIC PHOTOSENSITIVE MEMBER

[75] Inventors: Makoto Fujikura; Toshiyuki Ohno; Shigeharu Onuma, all of Hitachi; Kunihiro Tamahashi, Mito; Mitsuo Chigasaki; Yasuo Shimamura, both of Hitachi, all of Japan

[73] Assignees: Hitachi Ltd.; Hitachi Chemical Company, Ltd., both of Tokyo, Japan

[21] Appl. No.: 41,246

[22] Filed: Apr. 20, 1987

[30] Foreign Application Priority Data

Apr. 18, 1986 [JP] Japan ..... 61-89517

[51] Int. Cl.[4] ..... G03G 5/085

[52] U.S. Cl. ..... 430/64; 430/66; 430/84; 430/95

[58] Field of Search ..... 430/58, 63, 64, 65, 430/66, 67, 84, 95

[56] References Cited

U.S. PATENT DOCUMENTS

| | | | |
|---|---|---|---|
| 4,451,546 | 5/1984 | Kawamura et al. | 430/60 |
| 4,491,626 | 1/1985 | Kawamura et al. | 430/57 |
| 4,495,262 | 1/1985 | Matsuzaki et al. | 430/58 |
| 4,513,073 | 4/1985 | Jeffrey et al. | 430/65 |

*Primary Examiner*—John L. Goodrow

*Attorney, Agent, or Firm*—Antonelli, Terry & Wands

[57] ABSTRACT

The photoconductive layer (3) has a triple-layer structure comprised of an upper layer (33) made of amorphous silicon containing germanium and carbon, a middle layer (32) made of amorphous silicon containing germanium, and a lower layer (31) made of amorphous silicon. The upper layer (33) formed between a surface layer (4) and the middle layer (32), and the lower layer (31) formed between the middle layer (32) and a barrier layer (2) serve to reduce the energy difference and the interfacial state between respective layers thus, high electrophotographic sensitivity for a longer wavelength light can be obtained, and sensitivity in the oscillation wavelength of a GaAlAs diode laser improves effectively.

18 Claims, 5 Drawing Sheets

MULTILAYERED ELECTROPHOTOGRAPHIC PHOTOSENSITIVE MEMBER

BACKGROUND OF THE INVENTION

The present invention relates to an improvement in the structure of an electrophotographic photosensitive member, and more particularly to an electrophotographic photosensitive member for a laser beam printer using a diode laser. The present invention relates to an electrophotographic photosensitive member comprising a photoconductive layer made of amorphous silicon containing germanium incorporated thereinto, particularly to an electrophotographic photosensitive member comprising a conductive support and provided thereon in the following order, a barrier layer, a photoconductive layer, and a surface layer.

Description of Prior Art:

Amorphous selenium, a composite of cadmium sulfide (CdS) and an organic binder, an organic photoconductive member etc. has heretofore been used as an electrophotographic photosensitive member. A hydrogenated or halogenated amorphous silicon has recently attracted attention as a photoconductive materials for electrophotographic photosensitive member because of developing the preparation technique of high resistive film with high photoconductivity. This photoconductive material is believed to be a substantially ideal electrophotographic photosensitive member since it has not only a higher electrophotographic sensitivity than those of the conventional photoconductive materials but also a high hardness and a low toxicity.

Particularly the electrophotographic photosensitive member comprising a photoconductive layer made of amorphous silicon containing germanium, tin, or the like incorporated thereinto has a high sensitivity even at 750 to 820 nm which are oscillation wavelengths of the GaAlAs diode laser. Thus, some examples of such photosensitive materials are known as electrophotographic photosensitive members for a diode laser beam printer.

In, for example, Japanese Patent Laid-Open No. 192,044/1983, there is proposed which an electrophotographic photosensitive member having a structure as shown in FIG. 8. The conventional electrophotographic photosensitive member comprises a conductive support 101 and provided thereon in the following order, a high resistive film layer 102 (barrier layer or charge transport layer), a photoconductive layer 103 (charge generation layer), and a surface layer 104.

The high resistive film layer 102 (barrier layer or charge transport layer) is made of amorphous silicon containing carbon incorporated thereinto and has a dark resistivity of $10_{12}$ Ω·cm or more. The photoconductive layer 103 (charge generation layer) is made of amorphous silicon containing germanium and has the sensitivity in the long wavelength range. The surface layer 104 is made of amorphous silicon containing carbon incorporated thereinto and has an optical gap of 2.3 eV or more. The surface layer 104 is transparent to visible light and infrared light.

In the above conventional electrophotographic photosensitive member, the photoconductive layer 103 disadvantageously has a lowered resistance because of incorporation of germanium therein and hence is poor in the charge acceptance. However, the charge acceptance is supplemented by additional provision of the high resistive film layer 102 and the high resistive surface layer 104, each made of amorphous silicon containing carbon, above and under the photoconductive layer 103, thereby improving electrophotographic characteristics such as dark decay and residual potential etc. Thus, an electrophotographic photosensitive member having the high sensitivity for the long wavelength light is provided.

The above conventional electrophotographic photosensitive member is thought to be one of those satisfying requirements of a photosensitive member having a high sensitivity for a long wavelength light, but is yet insufficient in many aspects. Specifically, the sensitivity peak of the electrophotographic photosensitive member is located at 700 nm, which is largely deviated from the oscillation wavelengths of the GaAlAs diode laser. When the sensitivity peak position is adjusted to approach to the oscillation wavelengths of the GaAlAs diode laser by increasing the amount of germanium, the maximum value of the sensitivity is disadvantageously decreased.

For explaining the above conventional electrophotographic photosensitive member, a model band diagram as shown in FIG. 9 is prepared on the assumption that optical gap of respective amorphous silicon layers are pseudo-band gaps (numerals in FIG. 9 correspond to those in FIG. 8).

The optical gap of the photoconductive layer 103 sensitive to a GaAlAs diode laser of 750 to 820 nm is thought to be 1.5 eV, while that of the surface layer 104 is 2.3 eV or more, thus providing a large energy difference. The interface between the photoconductive layer 103 and the surface layer 104 is a place where the layer of combination of silicon and germanium having substantially the same covalent bond radii is in contact with the layer of combination of silicon and carbon having largely different bond radii. In such a place, the localized state (interfacial state) density is high.

Such a large energy difference and a high interfacial state remarkably spoil the sensitivity of the electrophotographic photosensitive member. Specifically, charge carriers (holes or electrons) generated in the photoconductive layer 103 cannot reach the surface of the electrophotographic photosensitive member and the conductive support 101 because they cannot clear the large energy difference or are captured by the interfacial state and, therefore, cannot serve as an effective photoelectric current.

In particular, the photoconductive layer 103 made of amorphous silicon containing germanium has an additional problem that it can take charge of only a weak electric field among the electric fields which have been applied to the whole electrophotographic photosensitive member because of its resistance lower than those of the other layers, which leads to an increase in recombination efficiency of hole and electron through the above-mentioned process, thereby causing lowering in the sensitivity.

Furthermore in, for example, Japanese Patent Laid-Open No. 190,955/1983, it is proposed that an electrophotographic photosensitive member comprises a conductive support and provided thereon in the following order, a barrier layer, a charge transport layer, and a charge generation layer. The charge transfer layer is made of amorphous silicon or amorphous silicon containing boron. The charge generation layer is made of amorphous silicon containing germanium.

Further in this Japanese patent a surface protection layer may be added on the charge generation layer. The surface protection layer is made of amorphous silicon layer or amorphous silicon layer containing boron and provided thereon amorphous silicon carbide layer containing carbon.

The latter electrophotographic photosensitive member has electrophotographic sensitivity characteristics for a long wavelength light, however such electrophotographic sensitivity characteristics are yet insufficient for a longer wavelength light in various aspects.

SUMMARY OF THE INVENTION

In view of both the above conventional electrophotographic photosensitive members, the present inventors have made investigations with a view to improving an electrophotographic photosensitive member comprising a surface layer made of amorphous silicon having a wide gap energy (more specifically amorphous silicon containing carbon), a photoconductive layer provided thereunder and having a sensitivity for a longer wavelength light, and a barrier layer provided thereunder.

An object of the present invention is to provide an electrophotographic photosensitive member wherein an electrophotographic sensitivity for a longer wavelength light can be improved.

Another object of the present invention is to provide an electrophotographic photosensitive member wherein an energy difference between the surface layer and the photoconductive layer can be reduced.

A further object of the present invention is to provide an electrophotographic photosensitive member wherein an interfacial state between the surface layer and the photoconductive layer can be reduced.

Still another object of the present invention is to provide an electrophotographic photosensitive member wherein an energy difference between the photoconductive layer and barrier layer can be reduced.

A still further object of the present invention is to provide an electrophotographic photosensitive member wherein an interfacial state between the photoconductive layer and barrier layer can be reduced.

Figure 1:
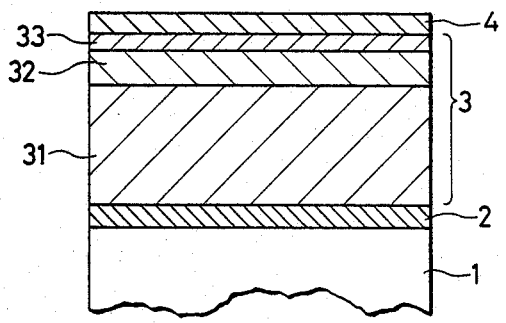
FIG. 1 is a cross-sectional view of the structure of the electrophotographic photosensitive member showing one embodiment of the present invention.

The structure of the electrophotographic photosensitive member of the present invention is schematically shown in FIG. 1. The electrophotographic photosensitive member comprises a conductive support or a substrate 1 and provided thereon in the following order, a barrier layer 2, a photoconductive layer 3 and a surface layer 4.

For the purpose of attaining the above-mentioned objects, the photoconductive layer 3 has a triple-layer composite structure comprised of an upper layer 33 made of amorphous silicon containing germanium and carbon (for example a-SiGeC:H) incorporated therein on the side of the surface layer 4, a middle layer 32 (caarge generation layer) made of amorphous silicon containing germanium (for example a-SiGe:H) incorporated therein, and a lower layer 31 (charge transport layer) made of amorphous silicon (for example a-SiC:H).

The first characteristic feature of the presen invention consists in the provision a first intermediate layer being formed between the surface layer and the photoconductive layer and being made of amorphous silicon containing germanium and carbon, for example, in the provision of the upper layer 33 containing germanium and carbon between the surface layer 4 and the middle layer 32 which functions as a change generation layer.

Figure 2:
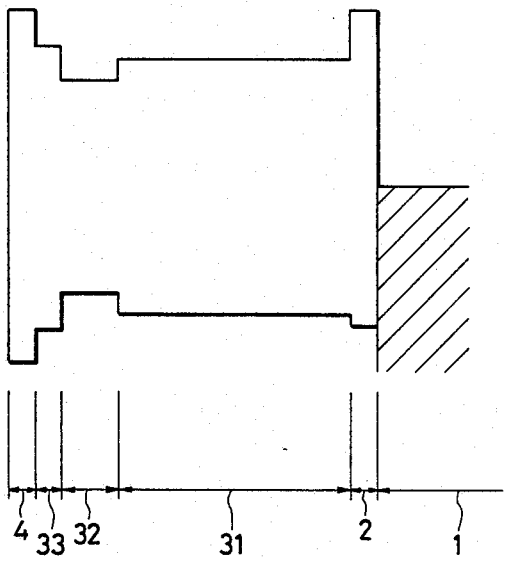
FIG. 2 is a model band diagram of the electrophotographic photosensitive member of the present invention of FIG. 1 drawn based on the values of optical gap.

The provision of the upper layer 33 containing germanium and carbon between the surface layer 4 and the middle layer 32 as shown in FIG. 1 contributes to reduction in the large energy difference as well as reduction in the interfacial state as shown in FIG. 2.

It is possible to gradually increase the optical gap of the upper layer 33 in passing from the side of the middle layer 32 towards the side of the surface layer 4 by increasing the carbon content or gradually reducing the germanium content of the upper layer 33 in passing from the side of the middle layer 32 towards the side of the surface layer 4. This brings about a further reduction in energy difference as well as in interfacial state, which enables the sensitivity for a longer wavelength light to be improved.

The second characteristic feature of the present invention consists in the provision of a second intermediate layer being formed between the photoconductive layer and the barrier layer and being made of amorphous silicon, for example, in the provision of the lower layer 31 made of amorphous silicon as a charge transport layer between the middle layer 32 which functions as a charge generation layer and the barrier layer 2.

Although the above-mentioned problems accompanying a large energy difference and high interfacial state between the middle layer 32 and the surface layer 4 are similarly present between the middle layer 32 and the barrier layer 2, the lower layer 31 is provided between the middle layer 32 and the barrier layer 2.

A longer wavelength light, particularly a GaAlAs diode laser beam, impinging on the photosensitive member is substantially completely absorbed in a region of a thickness of about 1 μm of the middle layer 32 (charge generation layer). Such a region of the middle layer 32 is formed at the upper portion of the side of the surface layer 4. The charge carriers are generated only in this region of the middle layer 32. Therefore, a region of the middle layer 32 and the lower layer 31, which exists at the side of the barrier layer 2 from the abovementioned region, can serve to transport the carriers and do not require specially the presence of germanium incorporated therein.

It is preferred that an amorphous silicon having a balanced characteristic in respect of carrier mobility and charge acceptance, particularly an amorphous silicon which has been made intrinsic be used as the lower layer 31.

The optical gap in the present invention is defined as follows. With respect to each monolayer of the barrier layer 2, the photoconductive layer 3, and the surface layer 4, the absorption coefficient for light $h\nu = 1.5 - 2.4$ eV is measured. Here, h is the Planck constant, and $\nu$ is a frequency of incident light. The absorption spectrum is plotted in the coordinate system, with the $h\nu$, of the equation as the abscissa, and the $\sqrt{\alpha h\nu}$, of the equation as the ordinate. Then the straight line portion of the graph appears therein. The straight line portion is shown with the relationship as formula $\sqrt{\alpha h\nu} \equiv (h\nu - E_g)$.

When the straight line portion of the graph is extended toward the abscissa, the intercept value on the abscissa, which is $E_g$ of the above formula, is defined as the optical gap.

The sensitivity of the electrophotographic photosensitive member in the present invention is obtained as follows. The electrophotographic photosensitive member is charged by corona discharge so as to attain the surface potential of about 400–500 V. When the light having a predetermined wavelength value irradiates on the electrophotographic photosensitive member, the surface potential of the electrophotographic photosensitive member is lowered rapidly as photoelectric current flows thereon. The electrophotographic photosensitive member is reduced in surface potential to half after a lapse of time (t; half value period) from the light irradiation starting time. Then the sensitivity (S) of the electrophotographic photosensitive member is obtained by following formula.

$$S = 1/I.t \ (m^2/mJ)$$

Here, I ($mW/m^2$) is an irradiation light intensity; t is a half value period of the surface potential.

The barrier layer 2, the photoconductive layer 3, and the surface layer 4 made of respective amorphous silicon compounds are successively laminated on such a conductive support 1 according to plasma CVD, reactive sputtering, reactive vacuum evaporation, ion plating, or the like methods.

For example, the films for the barrier layer 2, the photoconductive layer 3, and the surface layer 4 may be formed by the plasma CVD method using a mixture of gases selected from among monosilane ($SiH_4$), hydrocarbon, germane ($GeH_4$), diborane ($B_2H_6$), phosphine ($PH_5$), and hydrogen ($H_2$). Alternatively, the films may be formed by the reactive sputtering method using some of the abovementioned gases and a silicon and/or germanium target. Further, if desired, film forming methods such as reactive vacuum evaporation and ion plating may also be used.

Examples of the material of the conductive support 1 to be used in the present invention include metallic materials such as aluminum alloys, stainless steel, iron, steel, copper, copper alloys, nickel, nickel alloys, titanium, and titanium alloys; organic or inorganic materials having a thin metal film of aluminum, chromium, or the like provided thereon or having a thin conductive oxide film of indium tin oxide, tin oxide, indium oxide, or the like provided thereon, among which aluminum alloys are preferable and age-hardening type aluminum alloys are particularly preferable.

The conductive support or the substrate 1 is used in the form of a plate or a drum having a thickness of 1 to 20 mm, or a thin belt having a thickness of 0.1 to 1 mm.

It is preferred that every layer (the barrier layer 2, the photoconductive layer 3 and the surface layer 4) of the photoconductive layer 3 contains 5 to 40 atomic %, preferably 10 to 20 atomic %, of hydrogen and/or a halogen. The halogen is preferably fluorine.

It is preferred that the barrier layer 2 be made of hydrogenated or halogenated amorphous silicon or hydrogenated or halogenated amorphous silicon containin at least one element selected from among carbon, oxygen, and nitrogen. Further, 1 to 1,000 ppm of an element of group III of the periodic table, such as boron, aluminum, or gallium, is preferably added to such amorphous silicon to control valence electrons for obtaining a p-type semiconductor. A p-type semiconductor prepared by incorporating carbon and boron into such amorphous silicon is particularly preferable.

It is preferred that the barrier layer 2 have an optical gap of 1.8 to 2.5 eV.

It is preferred that amorphous silicon of the lower layer 31 of the photoconductive layer 3 include an element of group III of the periodic table, such as boron, aluminum, or gallium, particularly boron, which is preferably added to such amorphous silicon to make the same intrinsic.

It is preferred that the lower layer 31 have an intermediate optical gap value between those of the barrier layer 2 and the middle layer 32.

It is preferred that amorphous silicon containing germanium incorporated therein of the middle layer 32 have the optical gap of 1.4 to 1.6 eV so as to adapt to the oscillation wavelengths of 750–800 nm of the diode laser, which is narrower than than that of the common amorphous silicon. From the composition aspect, the above optical gap of the middle layer 32 is obtained from 20–60 atomic % of germanium against the total amount of silicon and germanium.

It is preferred that amorphous silicon containing germanium and carbon incorporated therein of the upper layer 33 have the optical gap of 1.2 to 3.0 eV through the various combination of the amount of germanium and silicon.

It is preferred that the upper layer 33 have an intermediate optical gap value between those of the middle layer 32 and the surface layer 4.

It is preferred that the optical gap of the upper layer 33 be made to lengthen gradually (continuously or in steps) in passing from the side of the middle layer 32 to the side of the surface layer 4. For the purpose of obtaining an optical gap of the upper layer 33, the amount of germanium is made to reduce gradually or the amount of carbon is made to increase gradually.

In order to fulfill the above-mentioned functions, it is preferred that the thickness of the upper layer 33 be in a range of 0.005 to 1 $\mu$m preferably in a range of 0.01 to 0.5 $\mu$m.

It is preferred that the surface layer 4 have an optical gap of 1.8 eV or more, which is a broader value than that of the common amorphous silicon.

It is preferred that amorphous silicon containing carbon incorporated thereinto is suitable so as obtain the range of the optical gap of 2.3 to 3.0 eV from the aspects of charge acceptance, resistance to environment, mechanical strength, resistance to printing, and thermal resistance.

It is preferred that amorphous silicon containing carbon incorporated thereinto having the range of the optical gap of 2.3 to 3.0 eV of the surface layer 4 is obtained from carbon of 40–90 atomic % against the total amount of silicon and carbon.

For obtaining most suitable electrophotographic photosensitive member adopted to oscillation wavelength of 750 to 820 nm, the surface layer 4 has an optical gap of 2.3 to 3.0 eV, the middle layer 32 has an optical gap energy of 1.4 to 1.6 eV, the upper layer 33 has an optical gap between those of the surface layer 4 and the middle layer 32. Further, the barrier layer 2 has an optical gap of 1.8 to 2.5 eV, and the lower layer 31 has an optical gap between those of the barrier layer 2 and the middle layer 32.

For explaining the electrophotographic photosensitive member of the present invention comprising the conductive support 1 and provided thereon in the following order, the barrier layer 2, the photoconductive layer 3, and the the surface layer 4, a model band diagram as shown in FIG. 2 is prepared on the assumption that optical gap of respective amorphous silicon layers are pseudo-band gaps (numerals in FIG. 2 correspond to those in FIG. 1).

The electrophotographic photosensitive member according to the present invention leads to realization of a high electrophotographic sensitivity for a long wavelength light, thus enabling excellent printing results to be obtained.

According to the electrophotographic photosensitive member of the present invention, the provision of an intermediate layer between the surface layer and the photoconductive layer serves to reduce the energy difference and the interfacial state between two layers, thereby effectively improving the sensitivity in the oscillation wavelength of the diode laser.

According to the electrophotographic photosensitive member of the present invention, the provision of an intermediate layer between the the photoconductive layer and the barrier layer serves to reduce the energy difference and the interfacial state between two layers, thereby effectively improving the sensitivity in the oscillation wavelength of the diode laser.

DETAILED DESCRIPTION OF THE INVENTTION

The present invention will now be described in detail with reference to the following examples that by no means limit the scope of the present invention.

Prior to the preparation of a multilayer structure according to the present invention, preliminary examination was made on the optical gap of each monolayer of the barrier layer 2, the photoconductive layer 3, and the surface layer 4.

Figure 3:
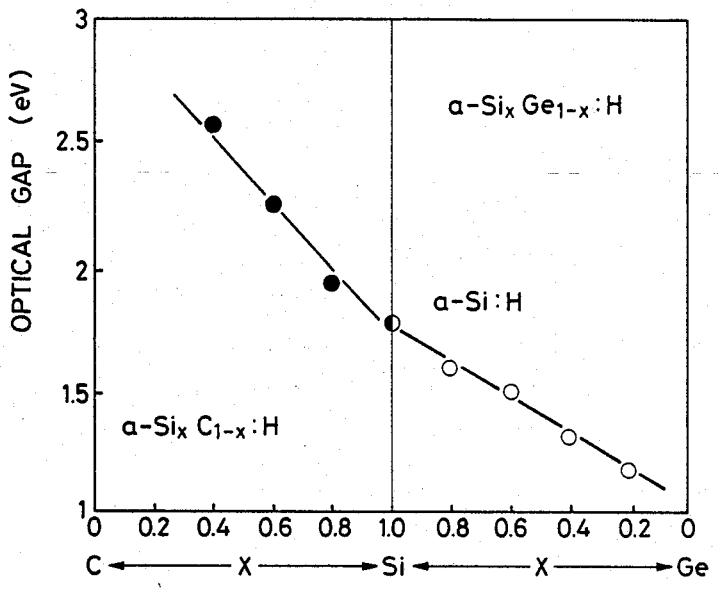
FIG. 3 is a diagram showing the optical gap of an amorphous silicon containing germanium and that of an amorphous silicon containing carbon.

FIG. 3 shows a relationship between the film composition and the optical gap with respect to a amorphous silicon containing carbon (hereinafter represented by "a-$Si_{1-x}Ge_x$:H") to be used as the barrier layer 2 and the surface layer 4, and an amorphous silicon containing germanium (hereinafter represented by "a-$Si_{1-x}Ge_x$:H") to be used as the middle layer 32.

Figure 4:
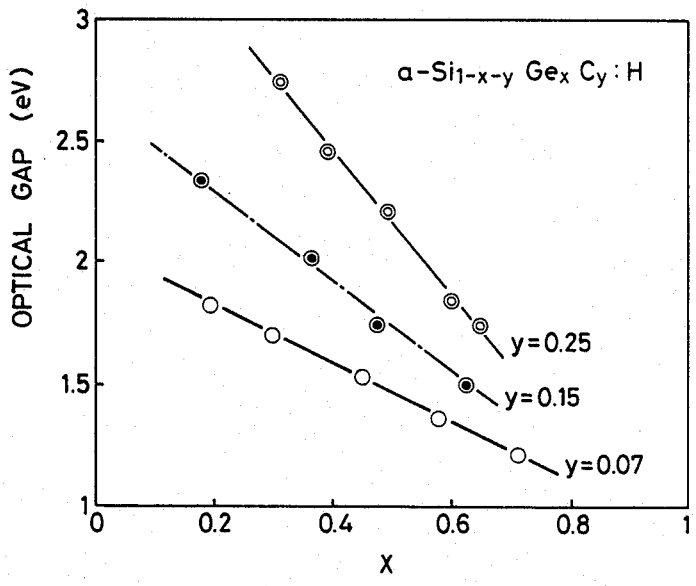
FIG. 4 is a diagram showing the optical gap of an amorphous silicon containing germanium and carbon.

FIG. 4 shows a relationship between the film composition and the optical gap with respect to an amorphous silicon containing germanium and carbon incorporated thereinto (hereinafter represented by "a-$Si_{1-x-y}Ge_xC_y$:H") to be used as the an upper layer 33. The optical gap varies in the range of about 1.2 to 3 eV depending on the amounts of carbon and germanium.

EXAMPLE 1

(1) An aluminum drum, the surface of which had been polished like a mirror, was set in a vacuum system. The vacuum system was evacuated to attain a pressure of $1\times10^{-5}$ Torr. A gas mixture of $C_2H_4$, $SiH_4$, $B_2H_6$, and $H_2$ was introduced therein until the pressure reached 0.3 Torr while a surface temperature of the aluminum drum was kept at 250° C. By glow discharge under conditions (a power of 200 W etc.), the gas mixture was decomposed to form a barrier layer consisting of a-$Si_{0.7}C_{0.3}$:H containing boron as an impurity (having an optical gap of 2.1 eV measured as a monolayer film) on the aluminum drum, having a thickness of 0.1 μm. (2) A gas mixture of $SiH_4$, $B_2H_6$ (diluted with $H_2$), and $H_2$ was introduced into the vacuum system until the pressure reached 0.3 Torr. By glow discharge under conditions (a high frequency voltage of 13.56 MHz and a radio frequency power of 200 W etc.), the gas mixture was decomposed to form a lower layer consisting of a-Si:H (having an optical gap 1.8 eV as measured as a monolayer film) having a thickness of 20 μm. (3) A gas mixture of $SiH_4$, $GeH_4$ (diluted with $H_2$), and $H_2$ was introduced into the vacuum system until the pressure reached 0.3 Torr. By glow discharge under conditions (a high frequency voltage of 13.56 MHz and a radio frequency power of 200 W etc.), the gas mixture was decomposed to form an upper layer consisting of a-$Si_{0.6}Ge_{0.4}$:H (having an optical gap of 1.5 eV measured as a monolayer film) having a thickness of 3 μm. (4) A gas mixture of $SiH_4$, $GeH_4$ (diluted with $H_2$), $C_2H_4$, and $H_2$ was introduced into the vacuum system until the pressure reached 0.3 Torr. By glow discharge under conditions (a high frequency voltage of 13.56 MHz and a radio frequency power of 200 W etc.), the gas mixture was decomposed to form an upper layer consisting of a-$Si_{0.7}Ge_{0.2}C_{0.1}$:H (having an optical gap of 1.9 eV measured as a monolayer film) and having a thickness of 0.2 μm. (5) A gas mixture of $SiH_4$, $C_2H_4$, and $H_2$ was introduced into the vacuum system until the pressure reached 0.3 Torr. By glow discharge under conditions (a high frequency of 13.56 MHz and a radio frequency power of 200 W etc.), the gas mixture was decomposed to form a surface layer consisting of a-$Si_{0.3}C_{0.7}$:H (having an optical gap of 2.6 eV measured as a monolayer film) having a thickness of 0.1 μm.

Figure 5:
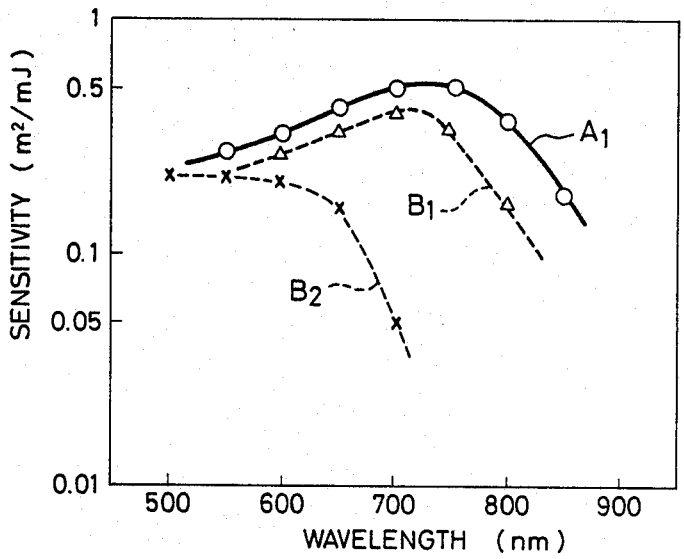
FIG. 5 is a diagram showing the spectral sensitivity characteristics of respective photosensitive members of Example 1 of the present invention and Comparative Examples 1 and 2.

The spectral sensitivity characteristics of the electrophotographic photosensitive member prepared by the film forming process comprising the steps (1) to (5) is shown by the curve $A_1$ in FIG. 5.

COMPARATIVE EXAMPLE 1

An electrophotographic photosensitive member having no upper layer was prepared in substantially the same manner as in Example 1 except that the step (4) was dispensed with.

The spectral sensitivity characteristics of the electrophotographic photosensitive member are shown by curve $B_1$ in FIG. 5.

COMPARATIVE EXAMPLE 2

An electrophotographic photosensitive member was prepared in substantially the same manner as in Example 1 except that the steps (3) and (4) were dispensed with. This electrophotographic photosensitive member corresponds to a conventional electrophotographic photosensitive member having no layer made of amorphous silicon containing germanium.

The spectral sensitivity characteristics of electrophotographic photosensitive member are shown by the curve $B_2$ in FIG. 5.

As shown in FIG. 5, the photosensitive member of Example 1 of the present invention has a peak sensitivity around 750 nm as compare with those of Comparative Examples 1 and 2. Thus, the electrophotographic photosensitive member of Example 1 of the present invention has an excellent sensitivity for a longer wavelength light.

EXAMPLE 2

Substantially the same procedure as in Example 1 except that the following step (4*a*) was employed instead of the step (4) (formation ofan upper layer) was repeated to prepare a photosensitive member of Example 2.

(4*a*) While a total pressure of 0.3 Torr was maintained with a gas mixture of $SiH_4$, $GeH_4$, $C_2H_4$, $B_2H_6$ (diluted with $H_2$), and $H_2$, the amount of $GeH_4$ was gradually decreased and, at the same time, the amount of $C_2H_4$ was gradually increased. According to this method, the composition was continuously changed from a-$Si_{0.6}Ge_{0.4}$:H through a-$Si_{1-x-y}Ge_xCy$:H to a-$Si_{0.3}C_{0.7}$:H.

Figure 6:
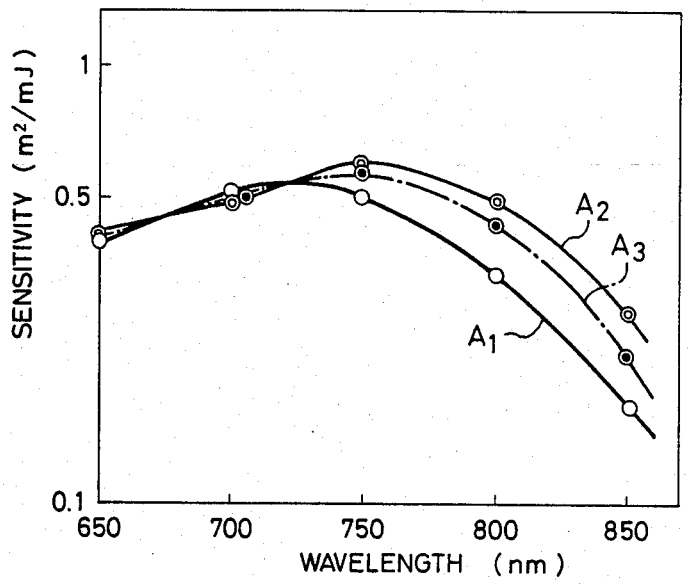
FIG. 6 is a diagram showing the spectral sensitivity characteristics of respective photosensitive members of Examples 1, 2 and 3 of the present invention.

The spectral sensitivity characteristics of the electrophotographic photosensitive member thus obtained are shown by the curve $A_2$ in FIG. 6. The electrophotographic photosensitive member had a superior sensitivity for a longer wavelength light to that of Example 1.

EXAMPLE 3

Substantially the same procedure as in Example 1 except that the composition of an upper layer was continuously changed from a-$Si_{0.7}Ge_{0.2}C_{0.1}$:H to a-$Si_{0.3}C_{0.7}$:H in substantially the same manner as in Example 2 was repeated to prepare an electrophotographic photosensitive member.

The spectral sensitivity characteristics of the electrophotographic photosensitive member are shown by the curve $A_3$ in FIG. 6. Substantially the same characteristics as in Example 2 were obtained.

The result of Example 1 is shown by the curve $A_1$ in FIG. 6. The following conclusion can be obtained by the comparison of Example 2 with Example 3 as shown in FIG. 6. A difference between the electrophotographic photosensitive members of Example 2 and Example 3 is that the former has a region of narrow optical gap (for example, 1.8 to 1.5 eV) while the latter has no such a region. Since charge carrier is generated in a region of narrow optical gap by the irradiation with a long wavelength light, the improvement in the sensitivity for a onger wavelength light is attained principally by reduction in the energy difference and the interfacial state

EXAMPLE 4

Substantially the same procedure as in Example 2 except that $CH_4$ was used as the carbon source instead of $C_2H_4$ in the step (4*a*) of forming an upper layer was repeated. Also in this method, the composition a-$Si_{1-x-y}Ge_xC_y$:H could be continuously changed while the amount of carbon was gradually increased. The other steps were the same as in Example 1.

Thus, an electrophotographic photosensitive member was prepared. The spectral sensitivity characteristics of the electrophotographic photosensitive member are shown by the curve $A_4$ in FIG. 7.

EXAMPLE 5

An upper layer was formed in substantially the same manner as in Example 4 except that $CH_4$ was initially introduced as the carbon source gas and gradually replaced with $C_2H_4$, and only $C_2H_4$ was finally introduced. The other steps were the same as in Example 1.

Thus, an electrophotographic photosensitive member was prepared. The spectral sensitivity characteristics of the electrophotographic photosensitive member are shown by the curve $A_5$ in FIG. 7.

Figure 7:
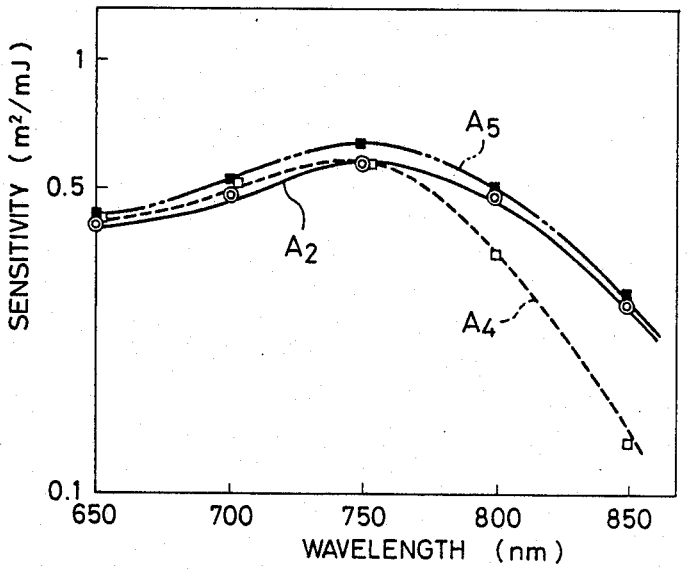
FIG. 7 is a diagram showing the spectral sensitivity characteristics of respective photosensitive members of Examples 2, 4 and 5 of the present invention.
Figure 8:
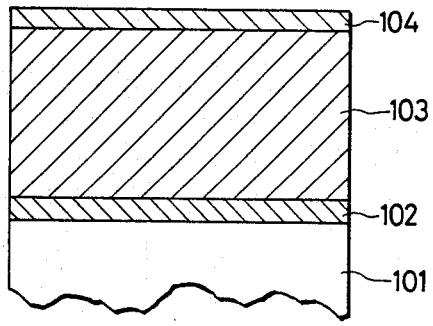
FIG. 8 PRIOR ART
FIG. 8 is a cross-sectional view of the structure of an example of the conventional electrophotographic photosensitive members.
Figure 9:
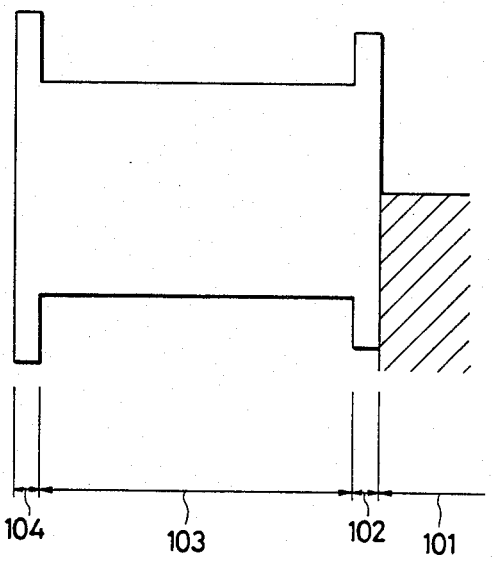
FIG. 9 PRIOR ART
FIG. 9 is a model band diagram of the electrophotographic photosensitive member of FIG. 8 drawn based on the values of optical gap.

The result of Example 2 is shown in the curve $A_2$ in FIG. 7. Where $CH_4$ is used as the carbon source gas, it is difficult to form a layer containing a large amount of carbon and, hence, having a broad optical gap (for example, 2.0 eV or more). Combined use of $CH_4$ with $C_2H_4$ can change the composition in a wider range and, therefore, is more effective.

We claim:

1. An electrophotographic photosensitive member comprising a conductive support and provided thereon in the following order, a barrier layer, a photoconductive layer made of amorphous silicon containing germanium and a surface layer, characterized in that an intermediate layer is formed between said surface layer and said photoconductive layer and is made of amorphous silicon containing germanium and carbon and has an intermediate optical gap value between those of said photoconductive layer and said surface layer.

2. An electrophotographic photosensitive member comprising a conductive support and provided thereon in the following order, a barrier layer, a photoconductive layer made of amorphous silicon containing germanium and a surface layer, characterized in that an intermediate layer is formed between said photoconductive layer and said barrier layer and is made of amorphous silicon and has an intermediate optical gap value between those of said photoconductive layer and said barrier layer.

3. An electrophotographic photosensitive member comprising a conductive support and provided thereon in the following order, a barrier layer, a photoconductive layer made of amorphous silicon containing germanium and a surface layer, characterized in that a first intermediate layer is formed between said surface layer and said photoconductive layer and is made of amorphous silicon containing germanium and carbon and has an intermediate optical gap value between those of said photoconductive layer and said surface layer and a seocnd intermediate layer is formed between said photoconductive layer and said carrier layer and is made of amorphous silicon.

4. An electrophotographic photosensitive member comprising a conductive support and provided thereon in the following order, a barrier layer, a photoconductive layer and a surface layer, characterized in that said photoconductive layer has a triple-layer structure comprises of an upper layer made of amorphous silicon containing germanium and carbon, a middle layer made of amorphous silicon containing germanium, and a lower layer made of amorphous silicon, said upper layer having an intermediate optical gap value between those of said middle layer and said surface layer, and said lower layer having an intermediate optical gap value between those for said middle layer and said barrier layer.

5. An electrophotographic photosensitive member according to claim 4, characterized in that each of said upper layer, said middle layer, and said lower layer of said photoconductive layer contains 5 to 40 atomic % of at least one of hydrogen or a halogen.

6. An electrophotographic photosensitive member according to claim 5, characterized in that said halogen is fluorine.

7. An electrophotographic photosensitive member according to claim 5, characterized in that said surface layer is made of at least one of hydrogenated or halogenated amorphous silicon containing carbon.

8. An elecrophotographic photosensitive member according to claim 4, characterized in that the optical gap of said upper layer of said photoconductive layer is made to increase continuously or in steps from a side adjacent said middle layer to a side adjacent said surface layer.

9. An electrophotographic photosensitive member according to claim 8, characterized in that the amount of said germanium contained in said upper layer of said photoconductive layer is made to decrease continuously or in steps from a side adjacent said middle layer to a side adjacent said surface layer.

10. An electrophotographic photosensitive member according to claim 8, characterized in that the amount of carbon contained in said upper layer of said photoconductive layer is made to increase continuously or intermitently from a side adjacent said middle layer to a side adjacent said surface layer.

11. An electrophotographic photosensitive member according to claim 4, characterized in that said lower layer of said photoconductive layer is made of amorphous silicon which has been made intrinsic by adding an element of group III of the periodic table thereto.

12. An electrophotographic photosensitive member according to in claim 11, characterized in that the element of group III of the periodic table is boron.

13. An electrophotographic photosensitive member according to claims 4 or 7, characterized in that said barrier layer is made of at least one of hydrogenated or halogenated amorphous silicon containing at least one orf carbon, oxygen, ornitrogen.

14. An electrophotographic photosensitive member according to claim 5, wherein said hydrogen or halogen is present in the amount of 10 to 20 atomic %.

15. An electrophotographic photosensitive member according to claim 4, wherein said carrier layer has an optical gap of 1.8 to 2.5 eV, said middle layer has an optical gap 1.4 to 1.6 eV, and said surface layer has an optical gap of 2.3 to 3.0 eV.

16. An electrophotographic photosensitive member according to claim 4, wherein said upper layer has a thickness of 0.005 to 1.0 μm.

17. An electrophotographic photosensitive membmer comprising a conductive support and provided thereon in the following order, a barrier layer, a photoconductive layer made of amorphous silicon containing germanium and a surface layer, characterized in that a first intermediate layer is formed between said surface layer and said photoconductive layer and is made of amorphous silicon containing germanium and carbon, said first intermediate layer having an intermediate optical gap value between the those or said photoconductive layer and said surface layer, and a second intermediate layer is formed between said photoconductive layer and said barrier layer and is made of amorphous silicon, said second intermediate layer having an intermediate optical gap value between those of said photoconductive layer and said barrier layer.

18. An electrophotographic photosensitive member according to claim 17, wherein said upper layer has a thickness of 0.01 to 0.5 μm.

* * * * *